US006554901B2

(12) United States Patent
Stefani

(10) Patent No.: US 6,554,901 B2
(45) Date of Patent: Apr. 29, 2003

(54) ROTARY MACHINE FOR DECORATING TILES

(75) Inventor: Franco Stefani, Modena (IT)

(73) Assignee: Syfal S.p.A., Sassuolo (IT)

( * ) Notice: Subject to any disclaimer, the term of this patent is extended or adjusted under 35 U.S.C. 154(b) by 28 days.

(21) Appl. No.: 09/918,542

(22) Filed: Aug. 1, 2001

(65) Prior Publication Data

US 2002/0043211 A1 Apr. 18, 2002

(30) Foreign Application Priority Data

Oct. 13, 2000 (IT) ..... MO2000A000221

(51) Int. Cl.[7] ..... B05C 1/02

(52) U.S. Cl. ..... 118/213; 118/223; 118/244; 118/255; 118/258; 101/127; 101/127.1

(58) Field of Search ..... 118/213, 223, 118/244, 255, 258, 301, 406; 101/127, 127.1; 427/272, 282, 428

(56) References Cited

U.S. PATENT DOCUMENTS 2,559,543 A * 7/1951 Muench ..... 118/301
4,287,849 A * 9/1981 Walchhuetter ..... 118/602
4,411,217 A * 10/1983 Valenti ..... 118/212
5,476,545 A * 12/1995 Schrauwers et al. ..... 118/668
5,477,781 A * 12/1995 Stefani ..... 101/153
5,849,082 A * 12/1998 Stefani ..... 118/212

* cited by examiner

*Primary Examiner*—Laura Edwards
(74) *Attorney, Agent, or Firm*—Browdy and Neimark, P.L.L.C.

(57) ABSTRACT

The machine comprises: a mobile rest plane for tiles on which the tiles transit in a predetermined advancement direction; a decorating apparatus which comprises a plurality of cylinders, located above the mobile rest plane; means for setting the plurality of cylinders in rotation each about an axis thereof, and with a predetermined stagger of one of the plurality of cylinders with respect to others of the plurality of cylinders. The means for setting the plurality of cylinders in rotation employ a mechanical transmission of drive to the plurality of cylinders which comprises a driven gear coaxially and solidly associated to each of the plurality of cylinders. The driven gears are drawn in rotation, with couplings allowing no relative dragging, by a chain and have diameters which are different from diameters of the plurality of cylinders to which they are solidly constrained. A relative position between any two of the plurality of cylinders is adjustable in a predetermined direction corresponding to an advancement direction of the mobile rest plane so that an angular stagger can be adjusted by means of simple displacements of one cylinder with respect to others.

7 Claims, 2 Drawing Sheets

ROTARY MACHINE FOR DECORATING TILES

BACKGROUND OF THE INVENTION

Specifically, though not exclusively, the invention is usefully applied in multi-coloured decoration lines for tiles. As is known, decorations requiring several different colours on a same tile are passed under a number of decorator heads corresponding to the number of colours.

Obviously good multi-coloured decorating must involve, as a prerequisite, perfect centring of the various single-colour patterns deposited during the various passages under the heads.

The prior art teaches rotary decorating machines comprising a single mobile rest plane for the tiles, from which the tiles are translated in a predetermined direction, above which plane a plurality of heads are located, arranged one after another. Each of these heads is constituted by a decorating cylinder which has etched upon it the pattern to be reproduced, and which is commanded to rotate about its own axis, parallel to the mobile rest plane and perpendicular to the direction of its movement, so that it rotates without dragging on the tiles. In the most up-to-date machines perfect centring of the etching on the tile, conveyed by the mobile rest plane, is regulated automatically by acting on the individual cylinder, which is commanded to assume the correct angular position in accordance with a tile reaching a predetermined position as it arrives along the mobile rest plane. This is possible thanks to a sophisticated electronic rotation control and an angular position of the cylinder with respect to a reference position.

These realisations, though perfectly functional and able to provide high-performance results, can however be considered too sophisticated for certain types of applications, and, consequently, unsuitable because in the final analysis they are indeed "too perfect" for the desired results in certain applications.

SUMMARY OF THE INVENTION

The main aim of the present invention is to provide a response to the above-cited need for greater simplicity.

An advantage of the invention is that it is constituted by a practically entirely mechanic device.

A further advantage of the invention is that it can be used in any type of rotary decorating machine, including all machines using a drum silk screen method. A further advantage is that the invention is simple and precise and can be rapidly adjusted to ready it for various glazing jobs.

DESCRIPTION OF THE DRAWINGS

These aims and advantages and more besides are all attained by the present invention, as it is characterised in the appended claims.

Further characteristics and advantages of the present invention win better emerge from the detailed description that follows, of a preferred but not exclusive embodiment thereof, illustrated purely by way of non-limiting example in the accompanying figures, in which.

DESCRIPTION OF THE PREFERRED EMBODIMENTS

Figure 1:
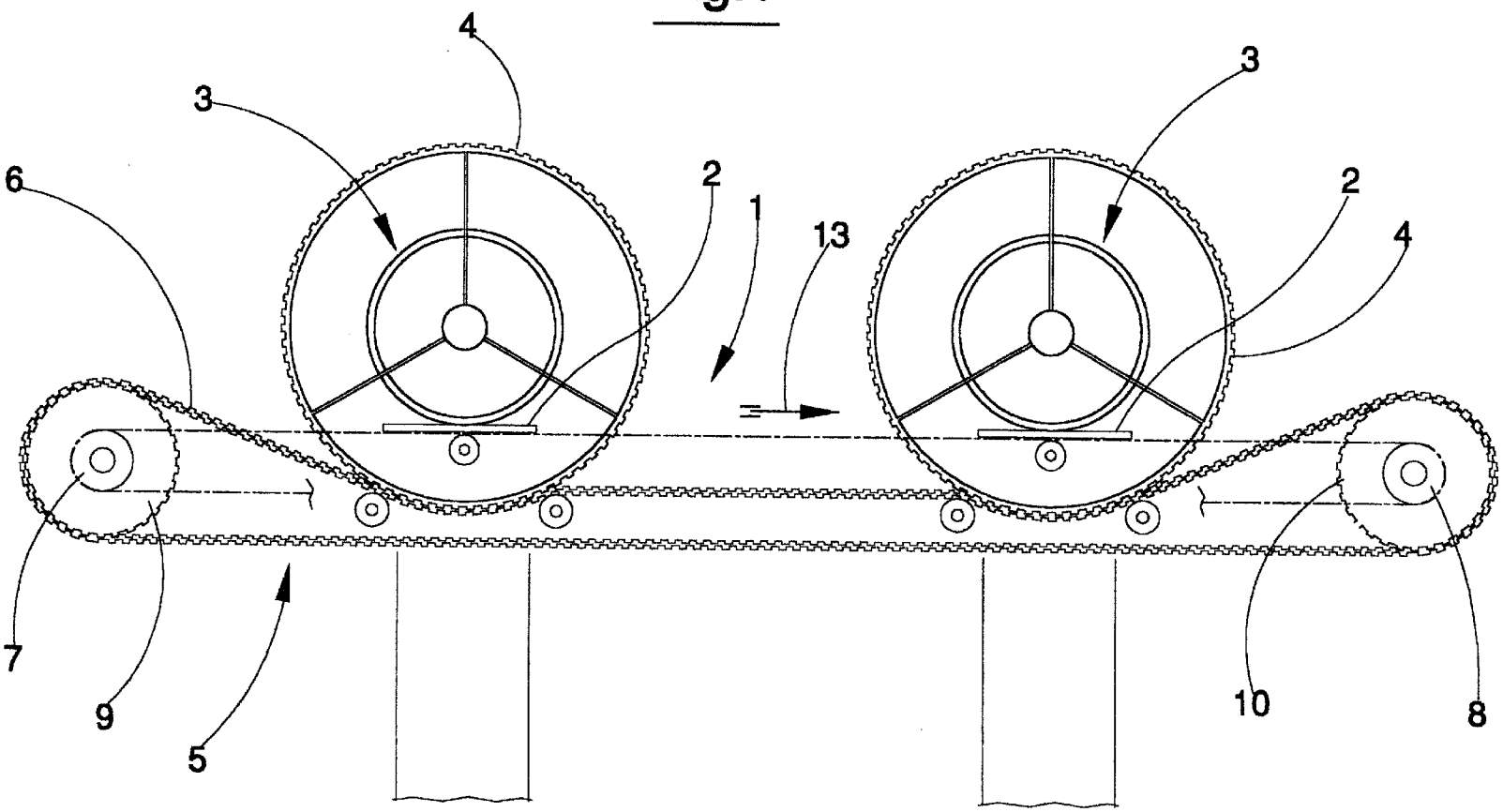
FIG. 1 is a schematic front view in vertical elevation.

With reference to the figures of the drawings, 1 denotes in its entirety a mobile rest plane for tile 2 decoration.

The tiles 2 are transported on the plane 1 in a predetermined direction, indicated by arrow 13.

A decorating apparatus comprises a plurality of cylinders 3 (in the example there are two), located above the mobile rest plane 1, as well as means for rotating the cylinders 3 about axes thereof, in a predetermined sequence with respect to each other.

The means for rotating use a mechanical drive transmission to the cylinders 3 which comprises a driven gear 4 for each cylinder 3, associated coaxially thereto.

The driven gears 4 are rotated by a drive organ in such a way as not to permit any relative dragging. The driven gears 4 also exhibit rotating diameters which are different to those of the respective cylinders 3 they are solidly constrained to.

The driven gears 4 are gearwheels having an external geared crown and the drive organ is a chain 5 of which the upper branch 6 is coupled with all the driven gears 4.

The upper branch 6 of the chain 5 coupled with the driven gears 4 is correlated with the movement of the mobile rest plane 1 in a predetermined ratio.

The mobile rest plane 1 is constituted by the upper branch of a ring-wound belt stretched between two drums having parallel axes 7 and 8.

The upper branch 6 is part of the chain 5 which is ring-wound about two gear wheels 9 and 10 which are coaxially arranged and solidly constrained to the drums 7 and 8.

In particular the ratio between the diameters of the gear wheels 9 and 10 and the diameters (including the width of the belt round about the gear wheels 9 and 10) of the drums 7 and 8 and the ratio between the diameters of the driven gears 4 and the rolling diameters of the respective cylinders 3 are calculated so that during motion the rolling of the cylinders 3 on the tiles 2 transiting on the mobile rest plane 1 occurs with no relative dragging.

In the illustrated embodiment there is a 0.5 ratio between the diameters of the driven gears 4 and the rolling diameters of the respective cylinders 3.

The advancement of the mobile rest plane 1 and the rolling of all the cylinders 3 are commanded by a single mechanism. This means that a movement of a given entity of the rest plane 1 corresponds to an exactly calculated rotation of the driven gears 4 and the respective cylinders 3 which are solidly constrained thereto.

Figure 2:
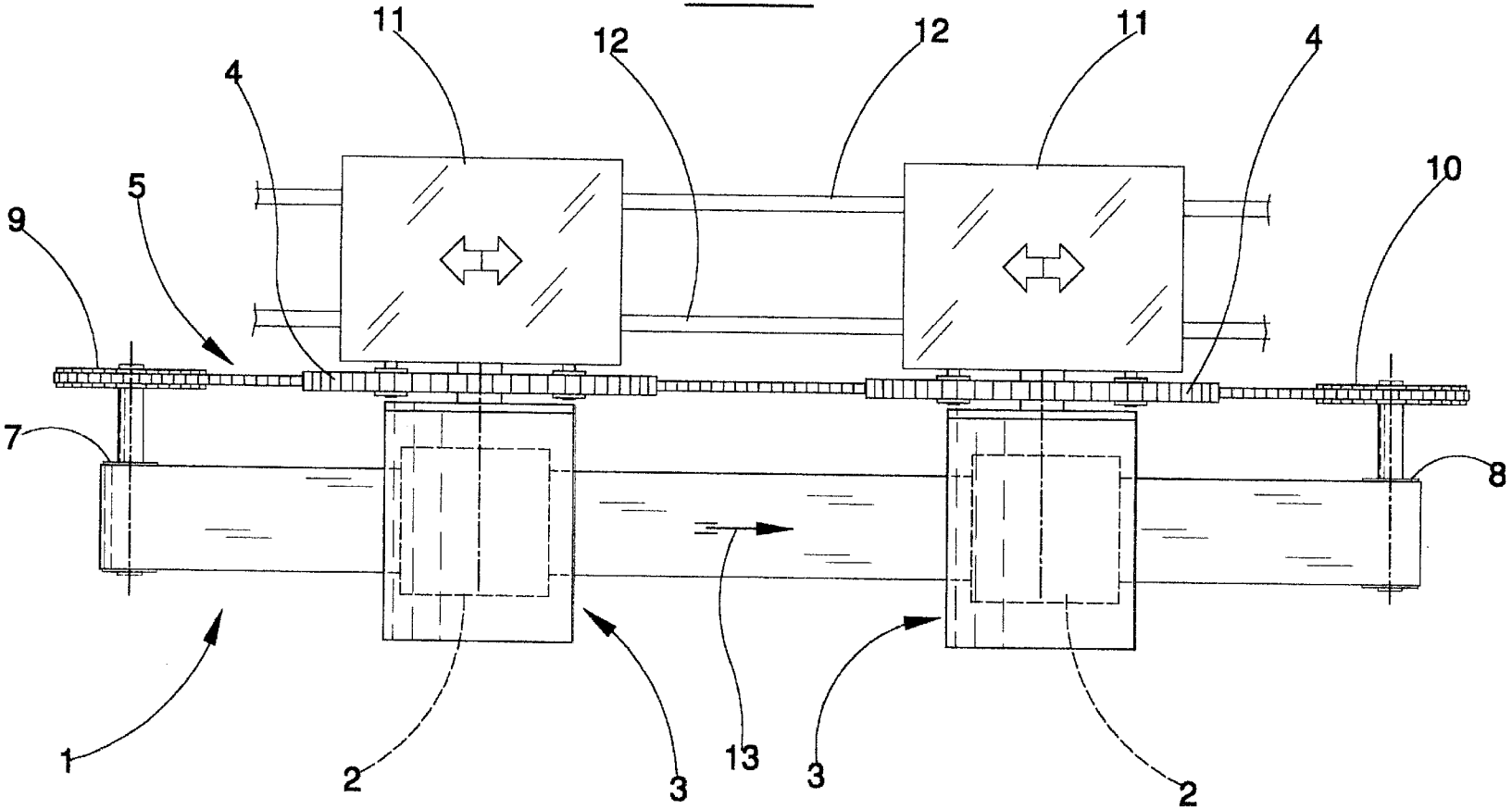
FIG. 2 is a schematic plan view from above of FIG. 1.

The relative positions of any two cylinders 3 are also adjustable in the advancement direction (indicated by the arrow 13) of the mobile rest plane 1. The total minus one of the plurality of cylinders 3, in the example the second of the two cylinders 3, are mounted on a frames, in the illustrated embodiment a frame 11, which frame (in FIG. 2) or frames (should there be more than two cylinders 3) is slidably coupled independently on guides 12 which enable a relative positioning of another cylinder or other cylinders 3 with respect to the first cylinder 3 in the advancement direction of the mobile rest plane 1. This possibility of positioning a cylinder 3 with respect to another along the advancement direction of the rest plane 1 enables a perfect staggering of the cylinders 3 with respect to the tile 2 being decorated.

An adjustment of a predetermined entity of a cylinder 3 along the guides 12 corresponds to a perfectly calculated relative rotation of the same cylinder 3 with respect to the other cylinder 3 or cylinders.

This clearly enables fine angular adjustment in relation to the etchings in the two cylinders 3—destined to apply two different colours on a same tile—so that the passage under the second of the cylinders 3 gives a perfectly centred second single-coloured pattern in relation to the first pattern deposited by the first cylinder.

What is claimed is:

1. A rotary machine for decorating tiles, comprising: a mobile rest plane for tiles on which the tiles transit in a predetermined advancement direction; a decorating apparatus which comprises a plurality of cylinders, located above the mobile rest plane; means for setting the plurality of cylinders in rotation each about an axis thereof, and with a predetermined stagger of one of the plurality of cylinders with respect to others of the plurality of cylinders; wherein the means for setting the plurality of cylinders in rotation employ a mechanical transmission of drive to the plurality of cylinders, which mechanical transmission comprises a plurality of driven gears coaxially and solidly associated one thereof to each of the plurality of cylinders; the plurality of driven gears being drawn in rotation, with couplings allowing no relative dragging, by a drive organ; the plurality of driven gears having diameters which are different from diameters of the plurality of cylinders to which they are solidly constrained; a relative position between any two of the plurality of cylinders being adjustable in a predetermined direction corresponding to an advancement direction of the mobile rest plane.

2. The machine of claim 1, wherein the driven gears are gear wheels and in that the drive organ is a chain of which one branch is coupled with the driven gears.

3. The machine of claim 2, wherein the movement of the one branch of the chain coupled with the driven gears is correlated with movement of the mobile rest plane in a predetermined ratio.

4. The machine of claim 3, wherein the mobile rest plane is constituted by an upper branch of a ring-wound belt stretched between two drums having parallel axes; the one branch of the chain ring-wound about two gear wheels being an upper branch thereof, the two gear wheels being coaxially arranged with respect to the drums, to which they are solidly constrained.

5. The machine of claim 4, wherein the ratio between the diameters of the two gear wheels and the diameters, including the width of the belt ring-wound there-about, of the drums and the ratio between the diameters of the driven gears and the diameters of the plurality of cylinders are such that during motion a rotation of the plurality of cylinders on the tiles transiting on the mobile rest plane occurs without any relative dragging.

6. The machine of claim 5, wherein the ratio between the diameters of the driven gears and the rolling diameters of the plurality of cylinders is of an entity of 0.5.

7. The machine of claim 6, wherein at least a totality minus one of the plurality of cylinders is mounted each on single frames which are individually coupled slidably on guides which enable each of the totality minus one of the plurality of cylinders to be positioned relative to one another along a direction corresponding to the advancement direction of the mobile rest plane.

* * * * *